US009458786B2

(12) United States Patent
Dölker

(10) Patent No.: US 9,458,786 B2
(45) Date of Patent: Oct. 4, 2016

(54) METHOD FOR MONITORING A PASSIVE PRESSURE REGULATION VALVE

(75) Inventor: Armin Dölker, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 207 days.

(21) Appl. No.: 14/115,168

(22) PCT Filed: Apr. 19, 2012

(86) PCT No.: PCT/EP2012/001694

§ 371 (c)(1),
(2), (4) Date: Jan. 10, 2014

(87) PCT Pub. No.: WO2012/150003

PCT Pub. Date: Nov. 8, 2012

(65) Prior Publication Data

US 2014/0109876 A1 Apr. 24, 2014

(30) Foreign Application Priority Data

May 2, 2011 (DE) ..... 10 2011 100 189

(51) Int. Cl.
*F02D 41/22* (2006.01)
*F02D 41/38* (2006.01)

(52) U.S. Cl.
CPC ..... *F02D 41/221* (2013.01); *F02D 41/222* (2013.01); *F02D 41/3863* (2013.01)

(58) Field of Classification Search
CPC ..... F02D 41/222; F02D 2041/223; F02D 2041/227; F02D 41/3863; F02D 41/221
See application file for complete search history.

(56) References Cited

U.S. PATENT DOCUMENTS 4,836,974 A * 6/1989 Ezekoye ..... F16K 37/0008 116/277
7,451,038 B2 11/2008 Kosiedowski et al.
7,610,901 B2 11/2009 Bucher et al.
8,261,605 B2 9/2012 Hermes et al.
2007/0251502 A1* 11/2007 Takayanagi ..... F02D 41/222 123/458

(Continued)

FOREIGN PATENT DOCUMENTS

DE 19626689 C1 11/1997
DE 102006040441 B3 2/2008

(Continued)

OTHER PUBLICATIONS

PCT International Search Report dated Jul. 20, 2012 for PCT/EP2012/001694.

*Primary Examiner* — Lindsay Low
*Assistant Examiner* — Jacob Amick
(74) *Attorney, Agent, or Firm* — Reising Ethington, P.C.

(57) ABSTRACT

Proposed is a method for monitoring a passive pressure limiting valve (11) via which fuel is discharged from the rail (6) of a common rail system into the fuel tank (2), in which method, upon the detection of a defective rail pressure sensor (9), a switch is made from a rail pressure regulation mode into an emergency mode, wherein in the emergency mode, the rail pressure is successively increased until the pressure limiting valve (11) reacts, in which method, in the emergency mode, the pressure limiting valve (11) is set as open when the starting phase of the internal combustion engine has additionally been detected as having ended, and in which method, in addition, the opening duration of the pressure limiting valve (11) is monitored.

11 Claims, 6 Drawing Sheets

(56) References Cited

U.S. PATENT DOCUMENTS

| | | | | |
|---|---|---|---|---|
| 2008/0156294 | A1* | 7/2008 | Albrecht | F02M 59/34 123/446 |
| 2009/0306830 | A1* | 12/2009 | Cummings | F15B 19/005 700/282 |
| 2012/0221226 | A1 | 8/2012 | Dolker | |

FOREIGN PATENT DOCUMENTS

| | | | |
|---|---|---|---|
| DE | 102006049266 | B3 | 3/2008 |
| DE | 102008000983 | A1 | 10/2009 |
| DE | 102009050468 | A1 | 4/2011 |
| EP | 2116711 | A1 | 11/2009 |

* cited by examiner

METHOD FOR MONITORING A PASSIVE PRESSURE REGULATION VALVE

CROSS REFERENCE TO RELATED APPLICATIONS

This application is a National Phase Application related to PCT/EP2012/001694 filed on Apr. 19, 2012, which application claims priority to DE 10 2011 100 189.5 filed on May 2, 2011, which applications are incorporated herein by reference in their entirety.

TECHNICAL FIELD

The present disclosure relates to exemplary methods for monitoring a passive pressure limiting valve via which fuel is discharged from the rail of a common rail system into the fuel tank, in which method, upon the detection of a defective rail pressure sensor, a switch is made from a rail pressure regulation mode into an emergency mode, wherein in the emergency mode, the rail pressure is gradually increased until the pressure limiting valve responds.

BACKGROUND

In one known method, the opening of the passive pressure limiting valve is monitored. An opened pressure limiting valve is detected following a load reduction if the rail pressure exceeds a limit, a steady-state operating state of the combustion engine is subsequently detected again and if a characteristic of the closed-loop control system deviates significantly from a reference value. Characteristic of the closed-loop control system is understood as the I component of the rail pressure controller or, for example, a PWM signal for acting on the suction throttle. A functional rail pressure sensor is imperative for the method presented.

Another known approach, is directed to a method for monitoring a passive pressure limiting valve following a load reduction. In a first step, a check is made whether the rail pressure, proceeding from a steady-state rail pressure, for example, 1800 bar, has exceeded a first, higher limit, for example 1850 bar. A check is then made in a second step whether the rail pressure exceeds a second, even higher limit, for example 1920 bar, in spite of a temporary charging of the suction throttle in the closing direction. If both limits have been exceeded, the pressure limiting valve is set as open. However, due to the variation of pressure limiting valves, it may be the case in practice that although the pressure limiting valve is detected as open by the evaluation program, said valve is actually still closed. This results in an operator error alarm and an erroneous follow-up response. A functional rail pressure sensor is also imperative for this method.

SUMMARY

The exemplary illustrations are based on the problem of detecting an open pressure limiting valve even in the event of the failure of the rail pressure sensor in a generic common rail system.

The problem is solved by claim 1. Other exemplary approaches are shown in the sub-claims.

Exemplary methods generally may include, upon detection of a defective rail sensor, a switch being made from a rail pressure regulation mode into an emergency mode, wherein in the emergency mode, the rail pressure is gradually increased until the pressure limiting valve responds.

Since information about the rail pressure is no longer available in the event of a defective rail sensor, the pressure limiting valve is then set as open if the starting phase of the combustion engine is also detected as having ended following the switch to emergency mode. After the pressure limiting valve has been set to open, its opening duration is monitored. Some exemplary approaches, therefore, may be based on the knowledge that the period of operation when the pressure limiting valve is open is crucial to an assessment of whether the pressure limiting valve is still tight following a restart or already has a tendency to leak. A leaking pressure limiting valve is known to result in overall reduced efficiency, since the fuel flows out of the rail into the fuel tank unused. It may be advantageous that in addition to a stable operating state in emergency mode, reliable fault localization in terms of an unwanted leak is possible. Overall, simple parameterization and implementation of the method is advantageous.

The opening duration of the pressure limiting valve set to open may be monitored by defining a first time limit and a second time limit for continued operation. Upon reaching the first time limit, a yellow alarm warning the operator is triggered. Upon reaching the second time limit, a red alarm is triggered as a recommendation that the pressure limiting valve should be replaced. If the combustion engine is switched off by the operator, the current opening duration will be saved.

If following the starting of the combustion engine an open pressure limiting valve is subsequently detected again, recording of the opening duration may continue from the point at which it was saved, and exceeding of the first and second time limits monitored.

In addition to the monitoring period, the frequency of opening operations is also recorded. A yellow alarm is triggered upon reaching a first number of opening operations and a red alarm upon reaching a second number of opening operations. This solution is therefore based on the knowledge that the number of opening operations may be helpful to an assessment of whether the pressure limiting valve is still tight following a restart or already has a tendency to leak.

BRIEF DESCRIPTION OF THE DRAWINGS

The figures show exemplary illustrations.

DETAILED DESCRIPTION

Figure 1:
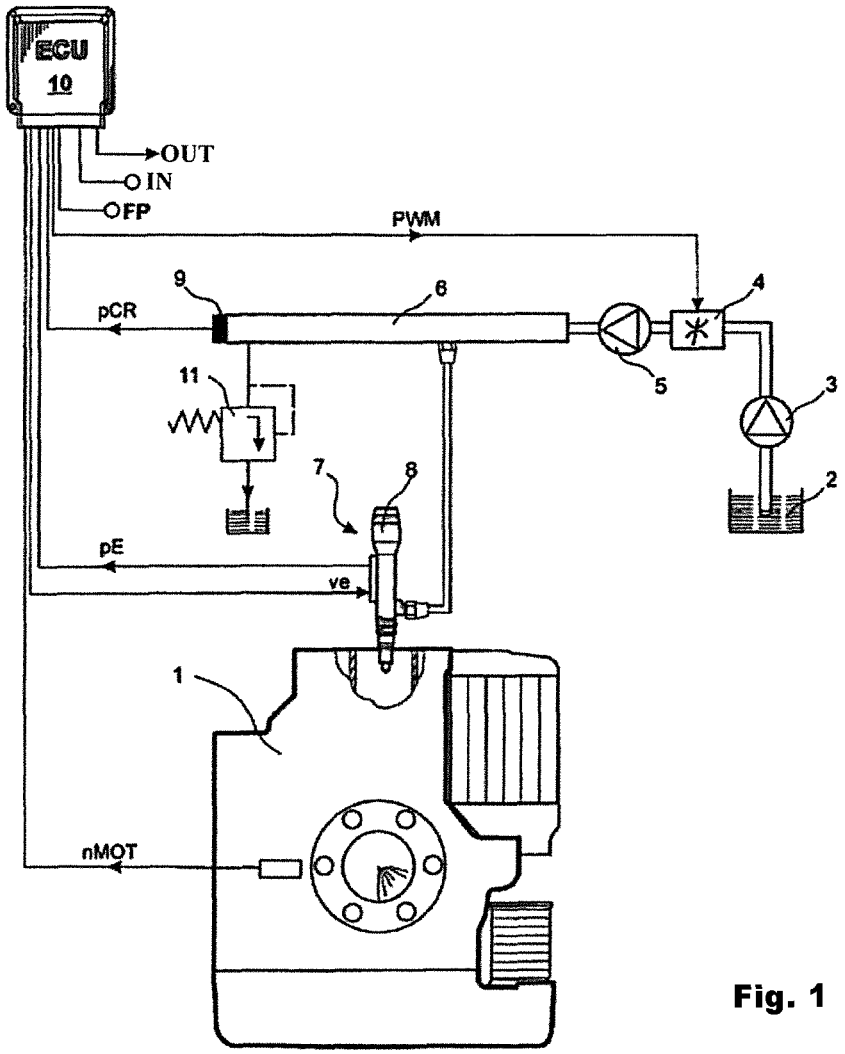
FIG. 1 shows a system diagram, according to an exemplary illustration.

FIG. 1 shows a system diagram of an electronically controlled combustion engine 1 having a common rail system, according to an exemplary illustration. The common rail system includes the following mechanical components: a low-pressure pump 3 for delivering fuel from a fuel tank 2, a variable suction throttle 4 for controlling the volume flow of the fuel flowing through the system, a high-pressure pump 5 for pumping the fuel at increased pressure, a rail 6 for storing the fuel and injectors 7 for injecting fuel into the combustion chambers of the combustion engine 1. The common rail system can also be optionally configured with individual accumulators, wherein, for example, an individual accumulator 8 is integrated into the injector 7 as additional buffer volume. A passive pressure limiting valve 11 is provided in the rail 6 as protection against impermissibly high pressure, which, for example, opens at a rail pressure level of 2400 bar and in an opened state controls the flow of fuel from the rail 6 to the fuel tank 2.

The mode of operation of the combustion engine 1 may be determined by an electronic control unit (ECU) 10. The electronic control unit 10 contains the standard components of a microcomputer system, for example a microprocessor, I/O modules, buffer and memory components (EEPROM, RAM). Operating characteristics that are relevant to the operation of the combustion engine 1 are applied in the memory components in input/output maps/characteristic curves. The electronic control unit 10 uses these to compute the output variables from the input variables. FIG. 1 shows the following input variables as examples: the rail pressure pCR, which is measured by means of a rail pressure sensor 9, an engine speed nMOT, a signal FP which represents an engine power output desired by the operator, optionally the individual accumulator pressure pE and an input variable IN. Other sensor signals, for example, the charge air pressure of a turbocharger, are included under the input variable IN. As output variables of the electronic control unit 10, FIG. 1 shows a PWM signal for controlling the suction throttle 4, a signal ve for controlling the injectors 7 (start/end of injection) and an output variable OUT. The output variable OUT is representative of additional control signals for controlling and regulating the combustion engine 1, for example, a control signal for activating a second turbocharger in register supercharging.

Figure 2:
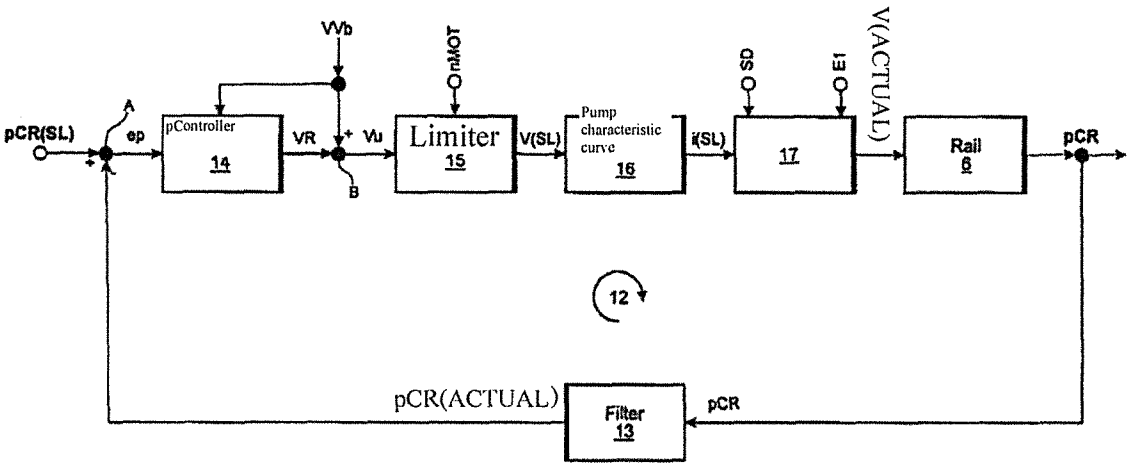
FIG. 2 shows an exemplary closed-loop pressure control system.

FIG. 2 shows a closed-loop pressure control system 12 for regulating the rail pressure pCR, according to an exemplary illustration. The input variables of the closed-loop pressure control system 12 are: a set rail pressure pCR (SL), set consumption VVb, engine speed nMOT, a signal SD as identification of a defective rail pressure sensor and a variable E1. Variable E1 includes, for example, a PWM base frequency, battery voltage and the ideal resistance of the suction throttle coil with feed pipe, which is included in the calculation of the PWM signal. The output variable of the closed-loop pressure control system 12 corresponds to the raw value of the rail pressure pCR. The actual rail pressure pCR (ACTUAL) is determined from the raw value of the rail pressure pCR by means of a filter 13. This value is then compared with the set rail pressure pCR (SL) at a summation point A, and a control deviation ep is obtained from this comparison. A correcting variable is calculated from the control deviation ep by means of a pressure regulator 14. The correcting variable represents a controller volume flow VR. The physical unit of the volume flow is liters per minute. The calculated set consumption VVb is added to the volume flow VR at a summation point B. The set consumption VVb is calculated according to a target injection volume and the engine speed. The result of the addition at the summation point B corresponds to an unlimited volume flow Vu, which is limited via a limiter 15 according to the engine speed nMOT. The output variable of the limiter 15 is a set volume flow V(SL), which is the input variable of a pump characteristic curve 16. The pump characteristic curve 16 assigns a set electric current i(SL) to the set volume flow V(SL). The set current i(SL) is an input variable of a functional block 17. The functional block 17 contains the calculation of the PWM signal. The output signal of the functional block 17 corresponds to the actual volume flow V (ACTUAL), which is pumped by the high-pressure pump into the rail 6. The pressure level pCR in the rail is recorded by the rail pressure sensor. The closed-loop control system 12 is thus closed.

If a defective rail pressure sensor is detected now (SD=1), a switch is made from a rail pressure regulation mode into an emergency mode. In the emergency mode, the rail pressure is gradually increased until the pressure limiting valve responds. The suction throttle is charged in the opening direction for this purpose, as a result of which the high-pressure pump can supply more fuel. This is achieved by setting the set current i(SL) as a control signal of the suction throttle to an emergency operation value, for example, zero amperes. As an alternative, the PWM signal can be set as a control signal of the suction throttle to an emergency operation value, for example zero percent. A switch can also be made from a pump characteristic curve in normal operation to a limiting curve in emergency operation. When the pressure limiting valve is open, the rail pressure is between the pressure level at engine idle, for example, 900 bar, and the pressure level at full throttle, for example, 700 bar. Since the rail pressure during emergency operation is always within this range, a stable operating state is ensured with consistent engine performance.

Figure 3:
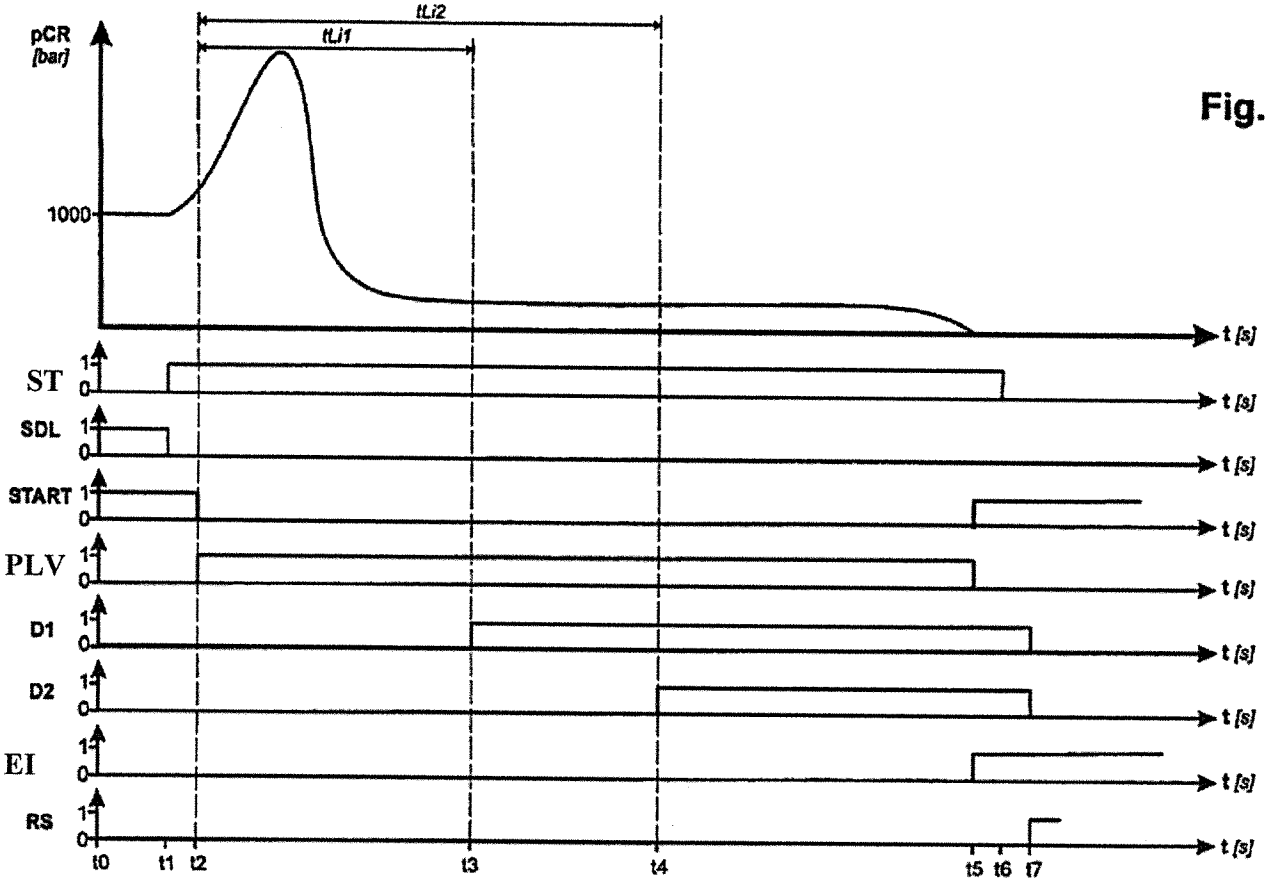
FIG. 3 shows an exemplary first time diagram.

FIG. 3 shows an exemplary time diagram of an opening operation of the pressure limiting valve with monitoring of the opening duration. The following are shown over the period: rail pressure pCR, the process variable SD for identification of a defective rail pressure sensor, a process variable ST for identification of the suction throttle flow, an engine start signal START, a process variable PLV for identification of the state of the pressure limiting valve, a process variable D1 for the yellow alarm, a process variable D2 for the red alarm, a process variable engine idle EI for identification of a combustion engine in a steady-state and an RS signal as reset signal.

At time t0, the system and the rail pressure sensor are defect-free. The process variable SD has the value SD=0. The rail pressure is pCR=1000 bar. The starting operation has not yet ended and consequently the process variable is START=1. At time t1, the failure of the rail pressure sensor is detected and the SD signal changes from 0 to 1. A switch is made from a rail pressure regulation mode into an emergency mode upon the detection of a defective rail pressure sensor. In emergency mode, the pressure limiting valve is opened selectively by setting the set current of the suction throttle to 0 amperes, for example. The process variable ST switches from 1 to ST=0. Because the suction throttle is fully open, the high-pressure pump supplies a greater volume flow to the rail, and consequently the rail pressure now increases after the time t1. At time t2, the engine speed (not shown) reaches the idle speed, i.e. the combustion engine leaves the starting phase. The START signal switches from 1 to 0 accordingly.

Since the rail pressure can no longer be measured, it is not possible to accurately determine when the pressure limiting valve opens. For this reason, the point at which the valve opens is assumed to be the same time as when both a defective rail pressure sensor was detected, here time t1, and the starting phase of the combustion engine ended. This is time t2. Consequently, the pressure limiting valve is set as open at time t2. The PLV signal now switches from 0 to PLV=1. From time t2, the opening duration of the pressure limiting valve is monitored for exceeding a first time limit tLi1 and a second time limit tLi2. In practical operation, the first time limit, tLi1, may be 3 operating hours, for example, and the second time limit, tLi2, 5 operating hours, for example. The first time limit tLi1 is reached at time t3. The process variable D1 therefore switches to the value D1=1 at time t3, which triggers a yellow alarm to warn the user. At time t4, the second time limit tLi2 is also reached. At this point, the process variable D2 changes to D2=1 which triggers a red alarm.

At time t5, the combustion engine is switched off by the operator, as a result of which the engine idle process variable is set at EI=1. Since the pressure limiting valve is closed when the combustion engine is in steady-state, the PLV signal is now reset to PLV=0. The combustion engine is in the starting phase again, the START signal is reset to 1. At time t6, the rail pressure sensor is replaced, the displayed sensor defect disappears, i.e. the SD signal is reset to SD=0. The reset button is pressed at time t7 (RS=1) whereby both alarms disappear, i.e. signals D1 and D2 are reset from 1 to 0. The alarms would also be reset even if the defective rail pressure sensor were not replaced at this point.

If the combustion engine is switched off before the opening duration has exceeded the first time limit tLi1 or the second time limit tLi2, the current opening duration is saved upon detection of engine idleness. If following a restart of the combustion engine, an open pressure limiting valve is subsequently detected again, recording of the saved opening duration will continue from the point at which it was saved and an exceeding of the limit monitored. This increases safety in that a pressure limiting valve with undesired leakage is detected.

Figure 4:
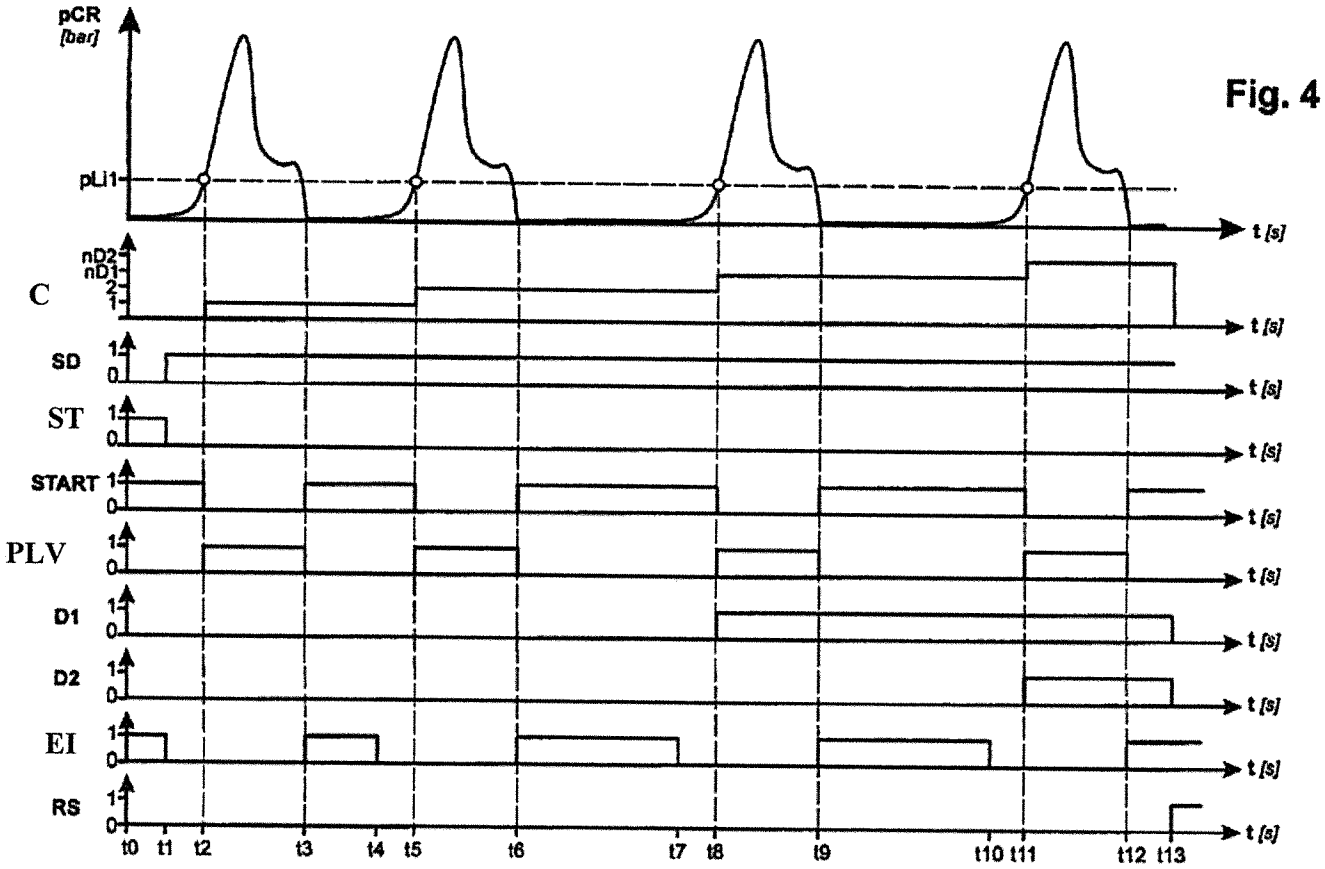
FIG. 4 shows an exemplary second time diagram with a plurality of opening operations.

FIG. 4 shows a method wherein in addition to the opening duration of the pressure limiting valve, the number of opening operations is also monitored, according to an exemplary illustration. For reasons of clarity, both the time limits tLi1 and tLi2 are omitted in FIG. 4. The following are shown over the period: the rail pressure pCR, a counter C, the process variable SD for identification of a defective rail pressure sensor, a process variable ST for identification of the suction throttle flow, an engine START signal, a process variable PLV for identification of the state of the pressure limiting valve, a process variable D1 for the yellow alarm, a process variable D2 for the red alarm, a process variable engine idle for identification of a combustion engine in a steady-state and an RS signal as reset signal.

At time t1, the system and the rail pressure sensor are defect-free. At time t1, two events coincide. Firstly, a running combustion engine is detected, i.e. the engine idle variable is reset to EI=0. Secondly, a defective rail pressure sensor, i.e. the SD variable is set to 1. As a result of this the suction throttle is charged in the opening direction.

The ST process variable is therefore ST=0. This leads to an increase in the rail pressure pCR. If the rail pressure pCR reaches the level pLi1 at time t2, the engine speed (not shown) is the same as the idle speed. The starting phase is thus over. The process variable START is reset. Since both conditions are now met, i.e. the rail pressure sensor is defective and the starting phase has ended, the pressure limiting valve is set as open. The PLV variable is set to PLV=1. Since the first opening operation of the pressure limiting valve has now been detected, the counter C displays the value C=1. At time t3, an engine idle is detected, the engine idle signal is set to EI=1. The pressure limiting valve is now closed and the PLV variable reset to PLV=0. The starting phase of the combustion engine is displayed again whilst the START variable is set to 1. The combustion engine has now been started again and consequently a running combustion engine is detected at time t4. The engine idle signal is thus set to EI=0. At t5, an open pressure limiting valve is detected again whereby the counter C is incremented to the value C=2. The combustion engine is subsequently switched off and restarted several times with a rail pressure sensor that is still defective. At time t8, the pressure limiting valve has opened nYELLOW times. The counter C now displays the value C=nD1 whereby the limit for triggering the yellow alarm is reached. The variable D1 is consequently set to value 1. At time t11, the pressure limiting valve has opened nRED times. The counter C now displays the value C=nD2 whereby a red alarm is triggered. This is shown by the variable D2 being set to the value D2=1. A stationary combustion engine is detected at time t12, the engine idle signal changes from EI=0 to EI=1. Since the combustion engine is now in a steady-state, the pressure limiting valve can be replaced. After the pressure limiting valve has been replaced, the rail pressure sensor defect is still active because said rail pressure sensor was not also replaced at the same time. This is shown by the SD signal which is still 1. At time t13, the reset signal is triggered and the RS signal assumes the value 1. As a result, both alarms are reset, i.e. the variables D1 and D2 are reset to 0. At the same time, the variable C is reset to 0 and consequently the counter can now restart from the beginning.

Figure 5:
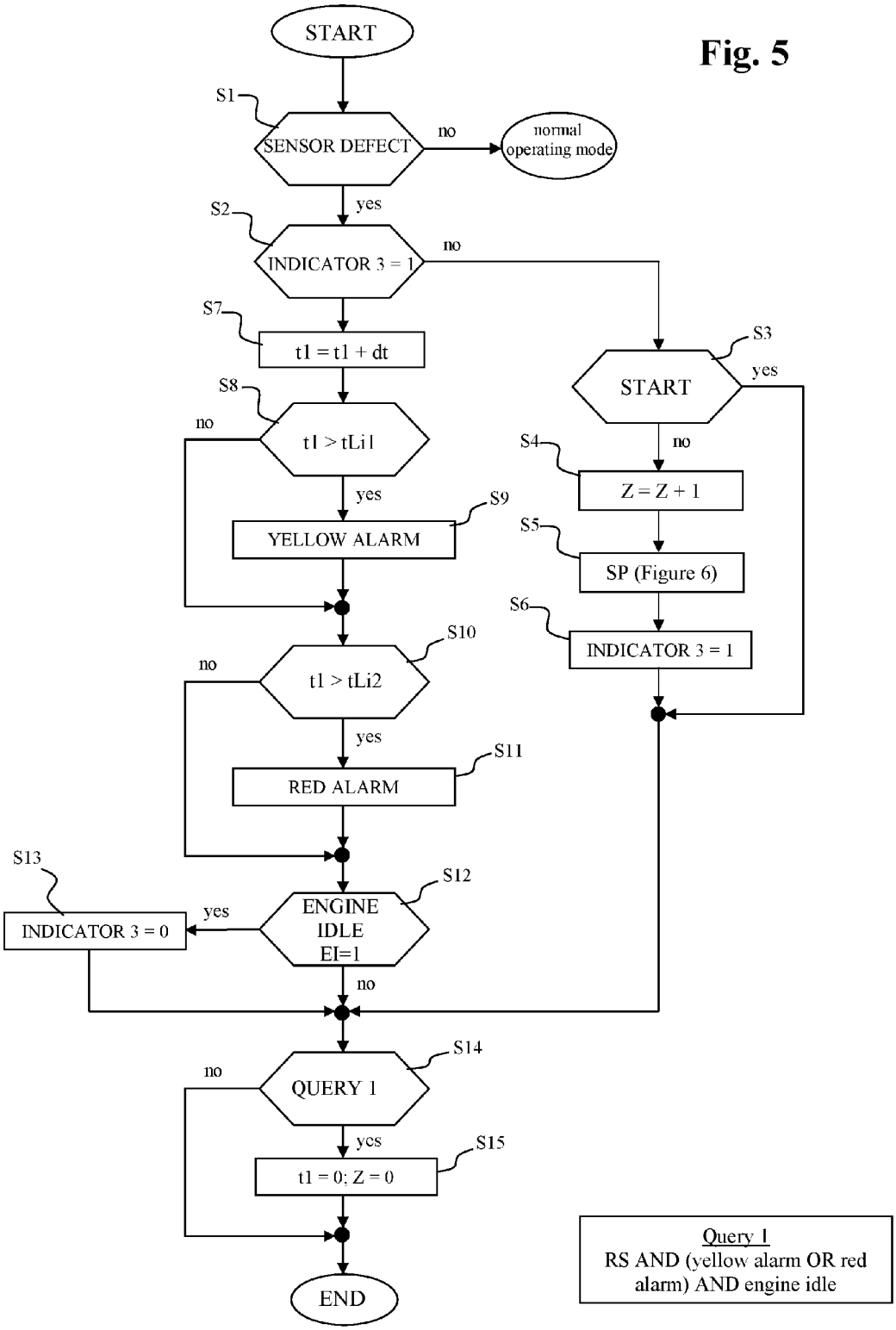
FIG. 5 shows a program flowchart, according to one exemplary illustration

FIG. 5 shows a program flowchart for monitoring the pressure limiting valve in the event of a defect in the rail pressure sensor, according to one exemplary approach. A check is made at S1 whether a defective rail pressure sensor has been detected. If this is not the case, query result S1: no, then the normal operation program continues. Otherwise the value of the indicator 3 is read at S2. The indicator 3 is then always set if the pressure limiting value is set as open. In this respect, the indicator 3 corresponds to the process variables PLV in FIG. 3 and FIG. 4. If the indicator 3=1, then program sections S7 to S13 will run. If the indicator 3=0, the program sections S3 to S6 will run.

Figure 6:
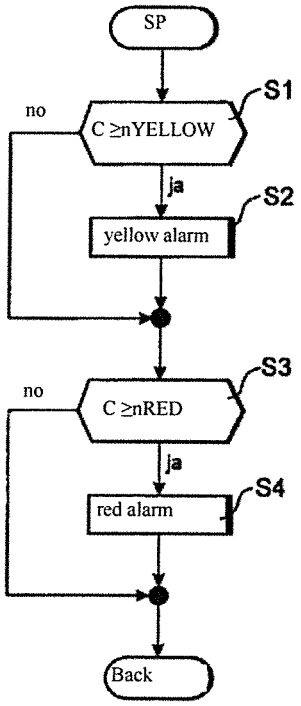
FIG. 6 shows a subprogram, according to an exemplary illustration.

If it has been established at S2 that the pressure limiting valve is still closed, a check is made at S3 whether the starting phase of the combustion engine has ended. The engine speed is compared with the idle speed for this purpose. If the starting phase has not yet ended, i.e. the START process variable is 1, the program will continue at S14. If the starting phase is over, query result S5: no, the counter C will be incremented at S4 and then at S5 in a subprogram SP of the counter. The subprogram is shown in FIG. 6 and will be explained in conjunction with said figure. The indicator 3=1 will then be set at S6, i.e. the pressure limiting valve will be set as open. The program will then continue at S14.

If it is detected at S2 that the pressure limiting valve has already been set as open, indicator 3=1, the time t1 will be incremented at S7. A check will then be made at S8 whether the time t1 has already exceeded the time limit tLi1, for example, 3 operating hours. If this is not the case, query result S8: no, the program will continue at S10. Otherwise, the yellow alarm will be set as a warning for the operator at S9. A check will then be made at S10 whether the time t1 has already exceeded the time limit tLi2, for example, 5 operating hours. If this is not the case, query result S10: no, the program will continue at S12. Otherwise, the red alarm will be set at S11. A check is made at S12 whether the combustion engine is in a steady-state. If this is not the case, the program will continue at S14. Otherwise, the indicator 3=0 will be set at S13, i.e. the pressure limiting valve is considered closed. At S14, the following is checked in a query 1: has the reset button been pressed (RS=1) and is there a yellow or a red alarm and the engine idle (EI=1). If the query receives a negative response, query result S14: no, the program ends. Otherwise, the time t1 and the counter C are set to 0 at S15. The program is then terminated.

The program flowchart in FIG. 5 also takes into account the scenario that the rail pressure sensor fails during ongoing operation. In this case, it will be detected at S3, after running through S1 and S2, that the starting phase has ended, query result S3: no. The counter C will then be incremented at S4, the counter reading checked at S5 and the indicator 3=1 set immediately at S6. Thus the pressure limiting valve will be considered open.

FIG. 6 shows an exemplary subprogram SP which may be used to check the counter C. The counter C will then always be incremented if an open pressure limiting valve is detected. A check is made at S1 whether the counter C is greater than or equal to a preselectable number nYELLOW, for example, 30. If this is not the case, the program continues with S3. Otherwise, query result S1: yes, the yellow alarm is triggered at S2 to warn the operator. A check is then made at S3 whether the counter C is greater than or equal to a preselectable number nRED, for example, 50. If this is not the case, then the subprogram is terminated. If, however, the counter is greater than/equal to nRED, a red alarm is triggered at S4. The red alarm shows the user that the pressure limiting valve should be replaced. The subprogram is then terminated and the system returns to the main program in FIG. 5 and continues at S5.

The invention claimed is:

1. Method for monitoring a passive pressure limiting valve via which fuel is discharged from a rail of a common rail system into a fuel tank, wherein upon the detection of a defective rail pressure sensor, a switch is made from a rail pressure regulation mode into an emergency mode, wherein in the emergency mode, the rail pressure is gradually increased until the pressure limiting valve responds, wherein the pressure limiting valve is set as open in the emergency mode if the starting phase of the combustion is also detected as having ended, and wherein the opening duration of the pressure limiting valve is additionally monitored.

2. Method according to claim 1, wherein the opening duration is monitored in that upon setting an open pressure limiting valve, a first time limit and a second time limit are defined for further operation, a yellow alarm is triggered upon reaching the first the time limit to warn the operator and a red alarm is triggered upon reaching the second time limit as a recommendation that the pressure limiting valve should be replaced.

3. Method according to claim 2, wherein the current opening duration is saved when the combustion engine is switched off and said duration continues to be recorded when the combustion engine is switched on again.

4. Method according to claim 3, wherein when the combustion engine is switched on again, the saved opening duration is set as relevant for the triggering of the yellow alarm and the red alarm if the pressure limiting valve is detected as open again.

5. Method according to claim 1, wherein in addition to monitoring the opening duration, the frequency of opening operations is also recorded.

6. Method according to claim 5, wherein the yellow alarm is triggered upon reaching a first number of opening operations and a red alarm is triggered upon reaching a second number of opening operations.

7. Method according to claim 1, wherein in normal operating mode the rail pressure level is regulated via a low-pressure side suction throttle as the first pressure control element in a closed-loop pressure control system, and in emergency operating mode the suction throttle is placed in a fully open state.

8. Method according to claim 1, wherein the opening duration is monitored in that upon setting an open pressure limiting valve, a first time limit and a second time limit are defined for further operation, an intermediate alarm is triggered upon reaching the first the time limit to warn the operator and a replacement alarm is triggered upon reaching the second time limit as a recommendation that the pressure limiting valve should be replaced.

9. Method according to claim 1, wherein in addition to monitoring the opening duration, a number of opening events of the pressure limiting valve is also recorded.

10. A method of monitoring a passive pressure limiting valve via which fuel is discharged from a rail of a common rail system into a fuel tank, the method comprising:

receiving an indication of a defective rail pressure sensor;

increasing a rail pressure until the pressure limiting valve responds;

switching from a rail pressure regulation mode into an emergency mode, wherein in the emergency mode, the pressure limiting valve is set as open if the starting phase of the combustion is also detected as having ended; and monitoring an opening duration of the pressure limiting valve.

11. The method of claim 10, further comprising monitoring a number of opening events of the pressure limiting valve.

* * * * *